United States Patent [19]

Finch et al.

[11] Patent Number: 4,930,563

[45] Date of Patent: Jun. 5, 1990

[54] MODULAR SECURITY DOOR SYSTEM

[76] Inventors: Harry E. Finch, 5273 Vista del Sol, Cypress, Calif. 90630; Geza J. Szayer, 24771 Acropolis Dr., Mission Viejo, Calif. 92691

[21] Appl. No.: 100,340

[22] Filed: Sep. 22, 1987

[51] Int. Cl.[5] ..... E06B 9/17

[52] U.S. Cl. ..... 160/271; 160/133

[58] Field of Search ..... 160/271, 267.1, 231, 160/133, 316

[56] References Cited

U.S. PATENT DOCUMENTS

| | | | |
|---|---|---|---|
| 1,587,940 | 6/1926 | Claveria | 160/271 |
| 2,065,813 | 12/1936 | Lang | 160/271 X |
| 3,981,343 | 9/1976 | DeVito | 160/190 X |

FOREIGN PATENT DOCUMENTS

| | | | |
|---|---|---|---|
| 744567 | 10/1966 | Canada | 160/271 |
| 300035 | 8/1932 | Italy | 160/271 |
| 8401204 | 11/1985 | Netherlands | 160/271 |

*Primary Examiner*—Blair M. Johnson

*Attorney, Agent, or Firm*—Henry M. Bissell

[57] ABSTRACT

A roll-up or curtain type door is disclosed which has modular components which are interchangeable for use on either side of the door, thereby reducing significantly the number of parts which must be manufactured for the door. The number of hardware items is also reduced significantly by designing components which slide together in a secure locking fashion, resulting in better ease of assembly and installation. In one embodiment, the roll-up door of the present invention is used to secure a storage unit with shelves.

18 Claims, 4 Drawing Sheets

MODULAR SECURITY DOOR SYSTEM

BACKGROUND OF THE INVENTION

The present invention relates generally to a roll-up or curtain type door and, more particularly, to an improved modular door requiring substantially fewer parts than comparable doors presently in use.

With ever-increasing urban crowding, the demand for storage space for infrequently used personal property has grown sharply. Such storage space, which used to be in a garage or basement, is not available in most apartments and condominiums, resulting in the development of the mini-warehouse or mini-storage facility. This type of facility features a secure, lockable storage space which is rented mainly to individuals. Since a wide variety of property may be stored in such facilities, including furniture and other large items, it is desirable to provide a large sealable door to provide access to individual storage areas. This eliminates conventional doors for the most part, since they are either too small or too unwieldy to be acceptable to the public.

Roll-up or curtain doors represent a convenient way to provide an easily operable closure, and they do so in a fairly limited space. Roll-up doors are typically constructed using a sheet of relatively thin metal which is formed by stamping or rolling to provide a plurality of horizontal corrugations extending the entire width of the door. This construction allows the door to be rolled up as it is raised for opening, thereby allowing the door to be stored in a cylindrical configuration at the top of the door opening. Vertical guide tracks, which may be made of extruded aluminum or formed galvanized steel, are typically mounted at opposite sides of the door opening and serve to guide the door as it moves up and down.

The top of the formed metal sheet is fastened to a barrel assembly which is constructed with a heavy wall, steel tube axle which supports thereon two or more galvanized steel drums or wheels. The barrel assembly is rotatably mounted between two brackets located slightly above the upper corners of the door opening. The barrel assembly is biased by one or two tempered steel torsion springs to balance the weight of the roll-up door, thereby allowing the door to be easily raised or lowered in a simple one-hand operation. Adhesively affixed tapes extend along the inner face of the door where contact is made with the galvanized steel drums or wheels to protect the door against wear by the galvanized steel drums or wheels, and to avoid rubbing of the successive layers of the roll-up door against each other.

The door also has a locking mechanism mounted thereon, which may be a simple sliding bolt type lock. With this mechanism, when the door is closed the bolt slides into a locking engagement with the guide track or with other metal means which prevents the door from being opened unless the bolt is opened. A simple padlock owned by the storage user may then be used to lock the bolt assembly.

This type of roll-up door is easy to operate, and will provide years of dependable service with virtually no maintenance. Such doors are relatively inexpensive, particularly when compared to similar roll-up doors which are made of a plurality of interlocking slats or panels.

From the preceding description, it will be appreciated that such doors are relatively easy to manufacture, and the business of manufacturing them is quite competitive. Accordingly it is desirable to minimize the cost of manufacturing the doors as much as possible while still retaining a high degree of quality and reliability. The minimization of the number of different parts required is an objective which reduces the cost of manufacturing, and also reduces the number of different parts which must be stocked.

Minimizing the quantity of hardware components such as nuts and bolts is also desirable, from two standpoints. First, the cost factor mandates using the smallest number of hardware items necessary. Secondly, and even more importantly, since such doors are sold in complete kits, it is desirable to minimize the number of parts and by so doing the amount of assembly required. Owners of storage facilities must either install the doors themselves, or pay to have the doors installed. It is apparent that a door which is simple, easy, and quick to install will have a significant competitive advantage over doors that are not.

Accordingly, it is an objective of the present invention to develop a design minimizing the number of parts needed in fabricating a curtain type door, thereby reducing the cost and the amount of work necessary to install the door. To the greatest degree possible, the door should be of a modular design which further facilitates both kitting and installation. The door must be installable using only simple hand tools, and it must be simple to install. Finally, the door must accomplish all of the aforesaid advantages while maintaining the highest degree of quality, durability, and dependability, and presenting no relative disadvantage.

SUMMARY OF THE INVENTION

The advantages discussed above are realized by the present invention. With this invention, the number of parts necessary for assembly of the door is reduced in two ways. First, and most significantly, the main components of the door are modular in design, and may be used on either side of the door. In other words, there are no longer right side and left side components; rather, the various parts are usable on either side of the door. This presents several advantages. The number of different parts which must be fabricated and stocked by the manufacturer is reduced significantly, since previously a number of the major components of the door were required to be manufactured in right side and left side versions, which were not interchangeable. In addition, the installer of the door need not worry about which side a particular part is designed to fit; instead, the part will fit either side interchangeably.

The second reduction in the number of parts required is obtained by minimizing the number of hardware items required. Insofar as possible, the assembly of the door is accomplished without hardware items such as bolts, nuts, and screws. This reduces the cost of the door, and also makes the assembly much easier and quicker. For example, the brackets used to secure the door guide tracks to the sides of the door opening slideably engage with the guide tracks instead of requiring bolts, nuts, and washers to secure them. The brackets used to carry the barrel assembly are similarly engaged onto the guide tracks, and require only a single bolt to retain them in place.

The reduction in parts is obtained at no cost in quality, durability, or long term dependability whatsoever. The roll-up doors of the present invention may be manufactured at lower cost and sold at reduced prices, giving them a tremendous competitive advantage over prior art roll-up doors. The installation of the doors is quicker and easier, and the door is just as secure. It will therefore be appreciated that the roll-up door of the present invention offers significant advantages over the art while incurring no relative disadvantage whatsoever.

DESCRIPTION OF THE DRAWINGS

These and other advantages of the present invention are best understood with reference to the drawings, in which.

DETAILED DESCRIPTION OF THE PREFERRED EMBODIMENT

Figure 1:
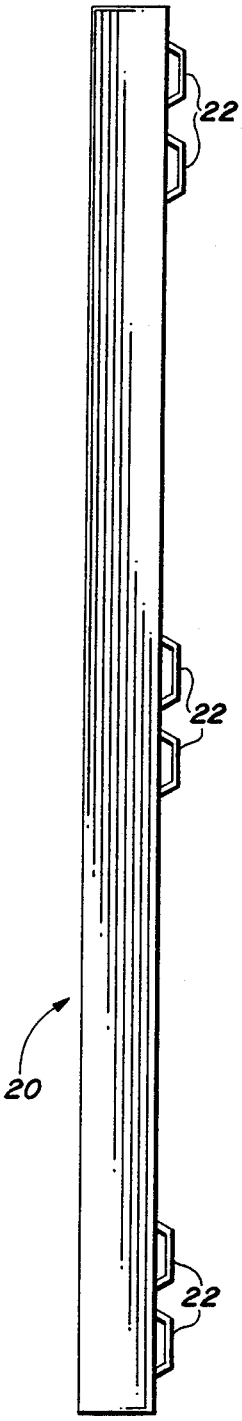
FIG. 1 is a side view of the interchangeable guide track used to support the roll-up door of the present invention on the left or right side thereof, illustrating the notches formed on the side thereof.
Figure 2:
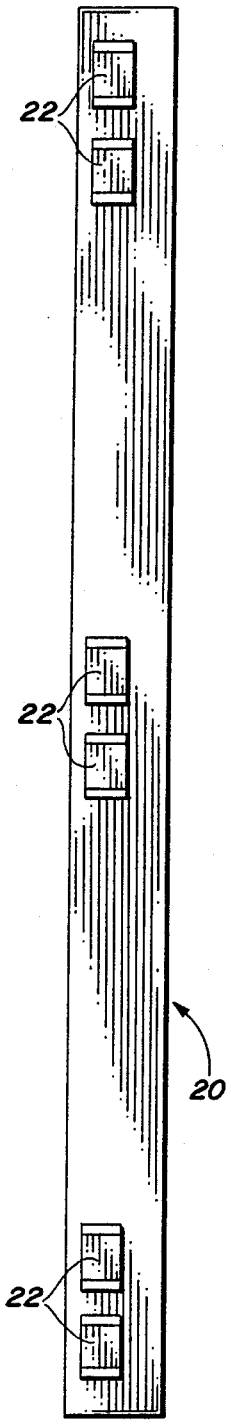
FIG. 2 is a back view of the interchangeable guide track shown in FIG. 1.
Figure 3:
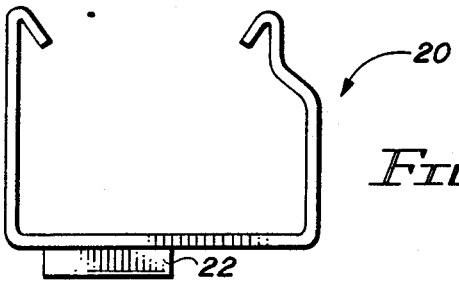
FIG. 3 is an end view of the interchangeable guide track shown in FIGS. 1 and 2, illustrating the bends therein.

The guide tracks used in previously known roll-up doors are typically made for either the right side or the left side of the door, and are not generally interchangeable. FIGS. 1 to 3 illustrate a guide track 20 which is used in the present invention interchangeably for either the right or left track. The guide track 20 of the preferred embodiment is formed of galvanized steel sheet stock bent as best shown in FIG. 3.

The guide track 20 has a plurality of pairs of retaining slots 22 formed therein to receive tabs, which will be described below in conjunction with FIG. 4. The retaining slots 22 are stamped into the guide track 20 at the time it is manufactured. One pair of the retaining slots 22 is located at each end of the guide track 20. The spacing between the retaining slots 22 is identical at each end of the guide track 20. Additional pairs of the retaining slots 22 may be located between the pairs of retaining slots 22 at either end of the guide track 20, depending on the length of the guide track 20. The guide track 20 shown in the figures have one such additional pair of retaining slots 22.

Figure 4:
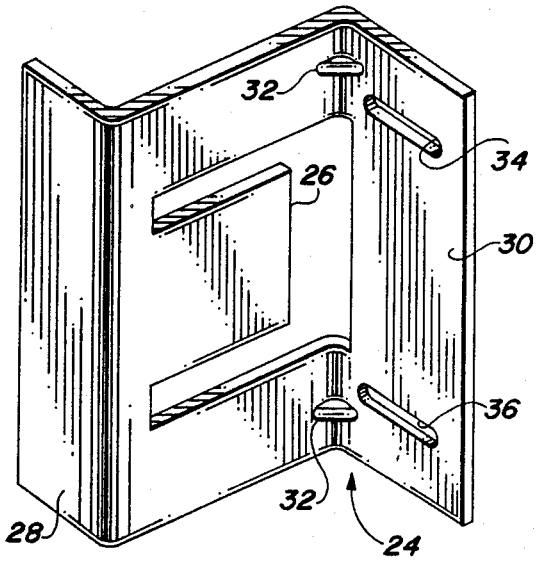
FIG. 4 is a perspective view of the brackets used to support the guide track shown in FIG. 1–3.

Referring next to FIG. 4, a mounting bracket 24 which may be used to mount the guide track 20 in position on the side of the opening into which the door is to be installed is illustrated. The mounting bracket 24, which is preferably made of stamped steel stock, has a tab 26 designed to precisely engage one of the retaining slots 22. When the mounting bracket 24 is installed into one of the retaining slots 22, it may be slid into the retaining slot 22 from the left of the guide track 20 as shown in FIG. 2. When the tab 26 is fully inserted into the retaining slot 22, a portion 28 of the mounting bracket 24 bent 90 degrees from the portion of the mounting bracket 24 containing the tab 26 will be flat against back side of the guide track 20 shown in FIG. 1.

A mounting portion 30 of the mounting bracket 24 is also bent 90 degrees from the portion of the mounting bracket 24 containing the tab 26. The mounting portion 30 is maintained in its 90 degree relationship by two stiffener protrusions 32 which are stamped into the mounting bracket 24. A first slot 34 and a second slot 36 are located on the mounting bracket 24. The first and second slots 34, 36 are of different sizes to allow different size mounting hardware to be used to attach the mounting brackets 24 to the side of the opening into which the door is to be installed. Only one of the two slots 34, 36 will generally be used in the installation of the door; having two different sizes of slots allows different sizes of hardware to be used as available or at the option of the installer.

It should also be noted that only one mounting bracket 24 will generally be used in each pair of retaining slots 22. The installer will have the option of deciding which of the pair of retaining slots 22 the mounting bracket 24 is installed into. The purpose of having the retaining slots 22 in pairs will become evident later, in conjunction with the discussion of FIGS. 9 and 10. It will be appreciated that in accordance with the principles of the present invention, the mounting bracket 24 is installed into the retaining slot 22 without needing additional hardware, thereby saving both the cost of such hardware and the time needed to install such hardware.

Figure 5:
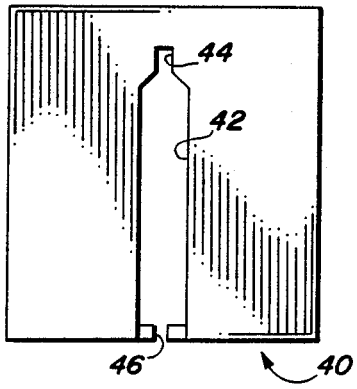
FIG. 5 is a side view of one of the barrel assembly U-shaped support brackets.
Figure 6:
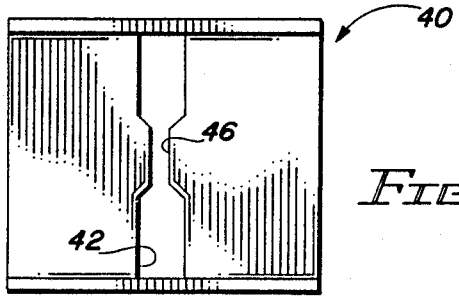
FIG. 6 is a top view of the U-shaped support bracket shown in FIG. 5.
Figure 7:
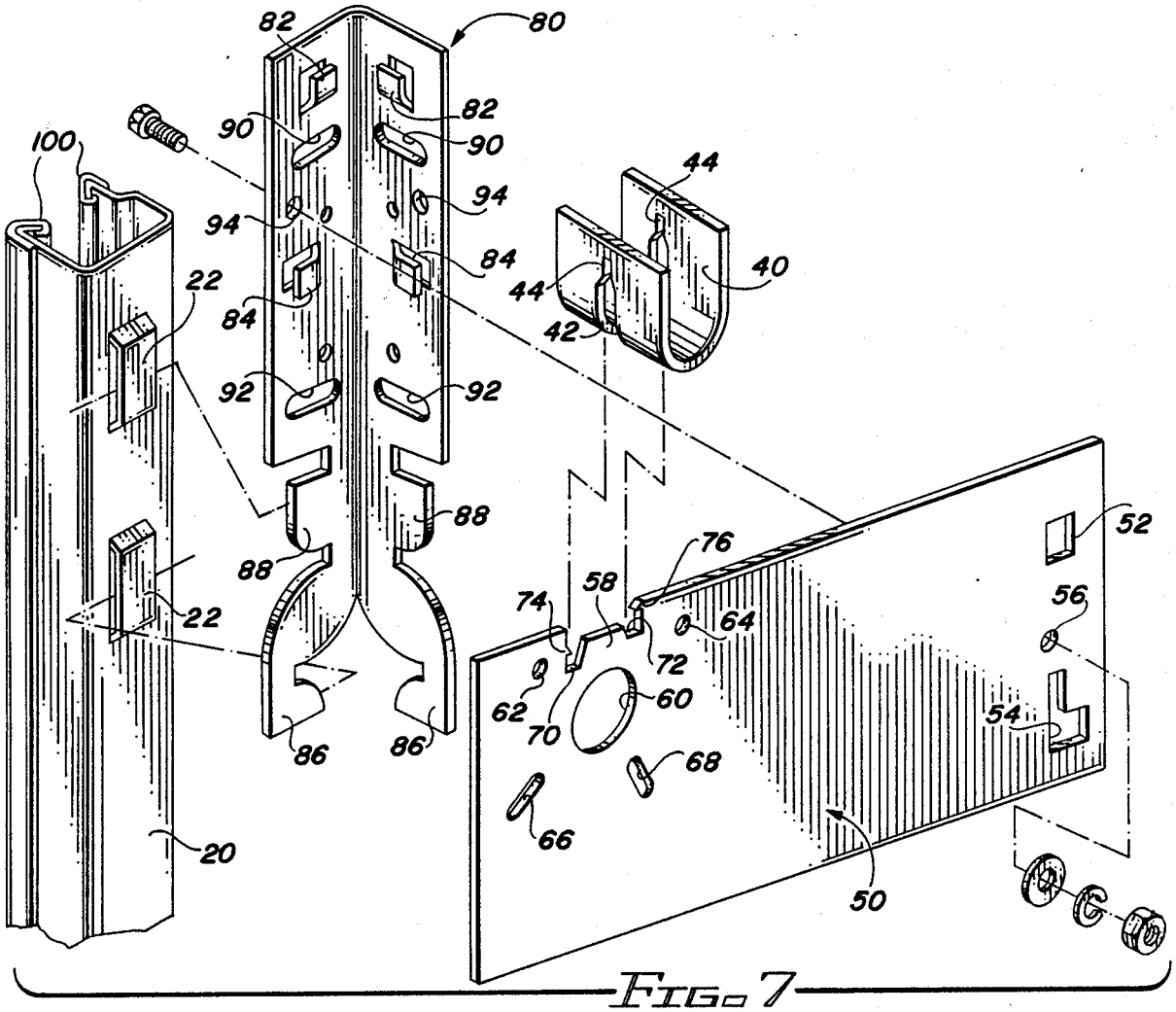
FIG. 7 is an exploded perspective view of of the interchangeable guide track of FIGS. 1–3, the U-shaped support bracket of FIGS. 5 and 6, the main barrel assembly support plate, and the plate support bracket.
Figure 10:
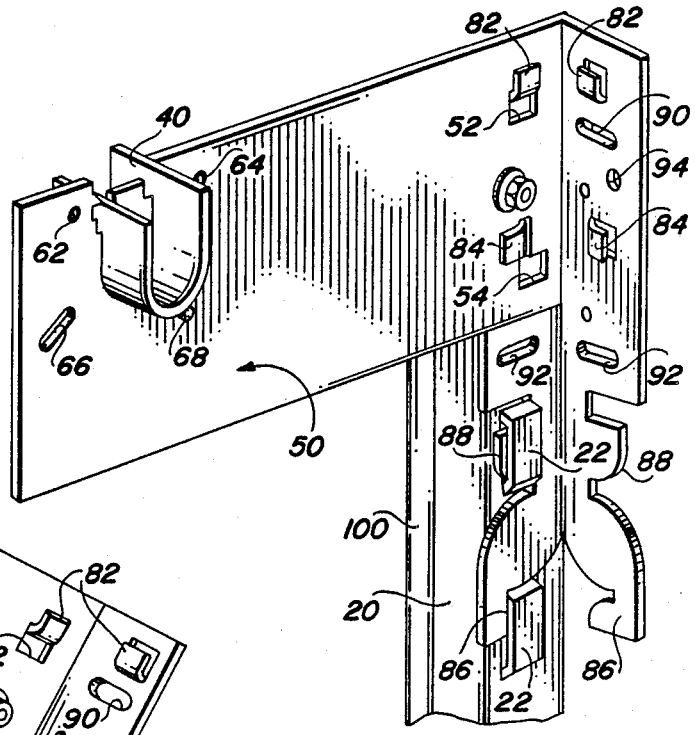
FIG. 10 is a perspective view of the assembled main barrel assembly support plate and plate support bracket fully installed at the top of the guide track.

Referring now to FIGS. 5–7, and also to FIG. 10, for example, a U-shaped axle support bracket 40 is illustrated, which U-shaped axle support bracket 40 will be used to support the barrel assembly, to be discussed later in conjunction with FIG. 11. The U-shaped support bracket 40 has a notch 42 therein, the notch 42 extending throughout the curved section of the U-shaped support bracket 40 and up much of the length of the legs of the U-shaped support bracket 40. The notch 42 has narrowed portions 44 at the ends of the notch 42 near the tops of the legs of the U-shaped support bracket 40. The notch 42 also has a narrowed portion 46 at the bottom of the curved portion of the notch 42.

Referring now to FIG. 7, a main barrel assembly support plate 50 is shown. At one end of the support plate 50, there are two notches in the support plate 50, one above the other. The upper notch is a rectangular notch 52, and the lower notch is an L-shaped notch 54.

Located roughly between the rectangular notch 52 and the L-shaped notch 54 is an aperture 56.

Near the other end and at the top of the support plate 50 is an irregularly shaped notch 58. Directly under the irregularly shaped notch 58 is a large circular aperture 60. Surrounding the large circular aperture 60 at approximately 90 degree intervals are two apertures 62, 64 and two slots 66, 68. The irregularly shaped notch 58 has a first deeper portion 70, and a second deeper portion 72. The first deeper portion 70 is nearer the end on the support plate 50 not having the rectangular notch 52 and the L-shaped notch 54 therein, while the second deeper portion 72 is nearer the end on the support plate 50 having the rectangular notch 52 and the L-shaped notch 54 therein. The first deeper portion 70 is also deeper than the second deeper portion 72, for reasons which will become evident later.

The irregularly shaped notch 58 has at the end nearer the end on the support plate 50 not having the rectangular notch 52 and the L-shaped notch 54 therein a retaining projection 74, which retaining projection 74 is located approximately half way down the first deeper portion 70. The irregularly shaped notch 58 also has at the end nearer the end on the support plate 50 having the rectangular notch 52 and the L-shaped notch 54 therein a second retaining projection 76, which retaining projection 76 is located near the top of the first deeper portion 70.

When the U-shaped support bracket 40 is placed into the irregularly shaped notch 58 with the rounded portion of the U downward, the top of the U-shaped support bracket 40 immediately above the narrowed portions 44 is forced past the the retaining projections 74, 76. The retaining projections 74, 76 then act to retain the U-shaped support bracket 40 in the position shown, for example, in FIGS. 9 and 10.

The narrowed portions 44 of the U-shaped support bracket 40 will grip the portions of the support plate 50 located immediately below the deeper portions 70, 72. Likewise, the narrowed portion 46 at the bottom of the U-shaped support bracket 40 will grip the portion of the support plate at the bottom of the large circular aperture 60. It should be noted that the U-shaped support bracket 40 fits onto the support plate 50 so a shaft supported within the rounded portion of the U-shape support bracket 40 will not contact the large circular aperture 60, which has a slightly larger diameter than the diameter of the rounded portion of the U-shaped support bracket 40. The bottom of the U-shaped support bracket 40 will also be directed slightly toward the end on the support plate 50 having the rectangular notch 52 and the L-shaped notch 54 therein by the second retaining projection 76, since when the barrel assembly and the door are installed the force will help to retain the U-shaped support bracket 40 in the irregularly shaped notch 58.

Figure 8:
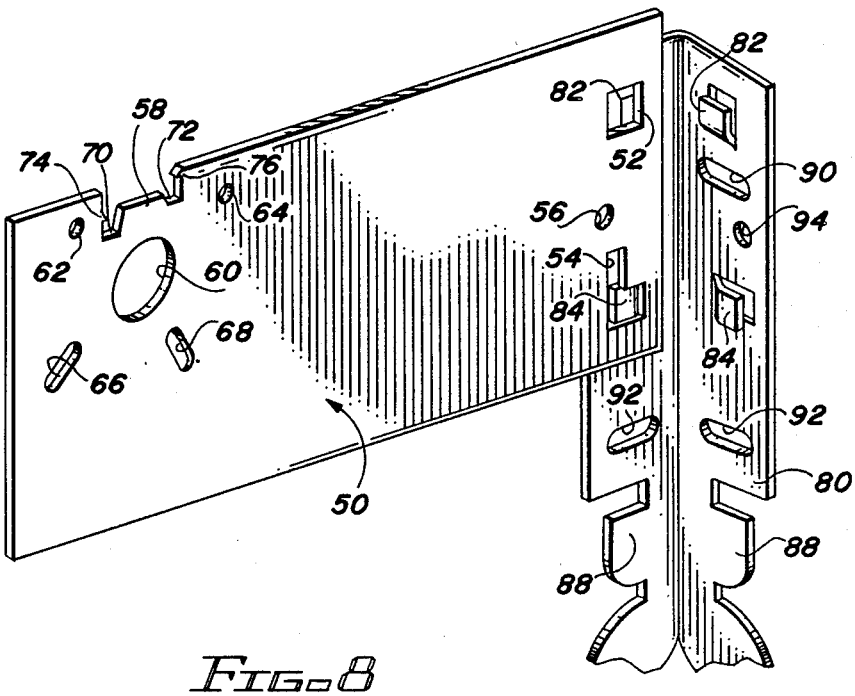
FIG. 8 is a perspective view of the main barrel assembly support plate being installed onto the plate support bracket.

Referring to FIG. 8, the installation of the support plate 50 onto a plate support bracket 80 is shown. The plate support bracket 80 is made from a piece of flat stock bent to have a 90 degree bend therein, as shown. The entire portions of the plate support bracket 80 on each side of the bend are mirror images. Two tabs are located on each side of the bend and on the top portion of the plate support bracket 80, with each tab being parallel to and spaced away from the surface of the plate support bracket 80. A first tab 82 is near the top of the plate support bracket 80 on each side of the bend, and the open end of the first tab 82 faces upwardly. A second tab 84 is below the first tab 82 on the plate support bracket 80 on each side of the bend, and the open end of the second tab 84 faces away from the bend on the plate support bracket 80.

Two additional tabs are located on each side of the bend and on the bottom portion of the plate support bracket 80, with each of these tabs being formed by material cut away from the plate support bracket 80. A third tab 86 is located at the bottom of the plate support bracket 80 on each side of the bend, and the third tab 86 faces toward the line defined by the bend. A fourth tab 88 is located above the third tab 86 on each side of the bend, and faces away from the line defined by the bend. The fourth tabs 88 are directly above the respective third tabs 86, and it will be appreciated that the third and fourth tabs 86, 88 will fit into two slots located one above the other, as will become evident as described below in conjunction with FIGS. 9 and 10.

Also located on the plate support bracket 80 on each side of the bend therein are two slots. A first slot 90 between the first tab 82 and the second tab 84 and a second slot 92 between the second tab 84 and the fourth tab 88 are of different sizes to allow different size mounting hardware to be used therein. One side of the plate support bracket 80 will be fastened to the side of the opening into which the door is to be installed; the other side is used to hold the support plate 50. Only one of the two slots 90, 92 will generally be used in the installation of the door. Located between the second tab 84 and the first slot 90 on each side of the bend is an aperture 94.

Figure 9:
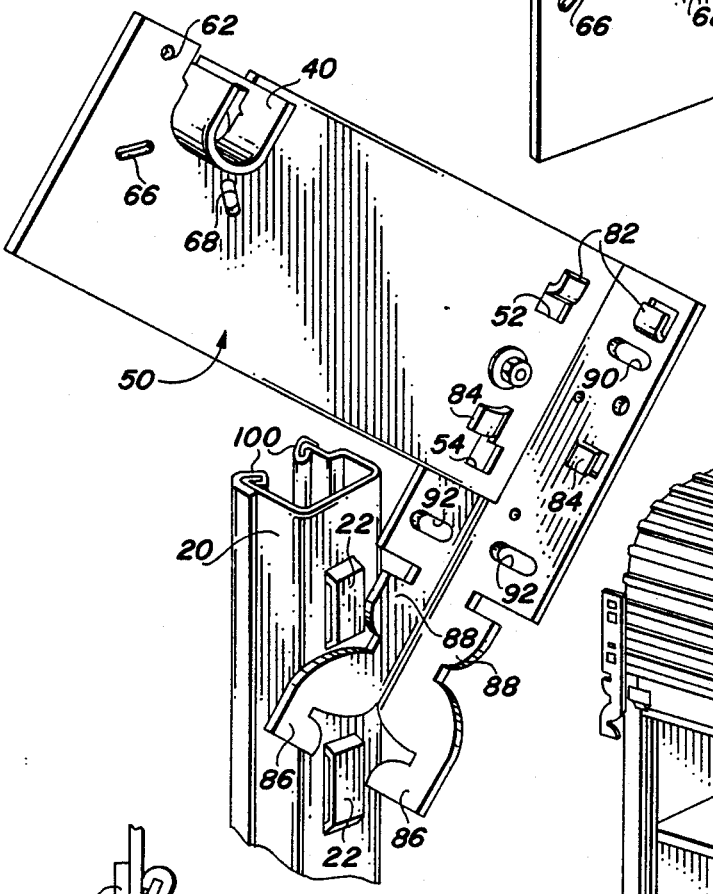
FIG. 9 is a perspective view of the assembled main barrel assembly support plate and plate support bracket being installed at the top of the guide track.

The installation of the support plate 50 onto the plate support bracket 80 may now be described As shown in FIG. 8, the second tab 84 is inserted into the bottom portion of the L-shaped notch 54. The support plate 50 is then pushed toward the bend in the plate support bracket 80, causing the second tab 84 to move to engage the surface of the support plate 50 around the the L-shaped notch 54, and also causing the first tab 82 to fit through the rectangular notch 52. The support plate 50 is then moved downwardly with respect to the plate support bracket 80, causing the second tab 84 to move upward into the top of the L-shaped notch 54, and also causing the first tab 82 to engage the surface of the support plate 50 above the rectangular notch 52, as shown in FIGS. 9 and 10, for example. A bolt (not shown in FIG. 7) may be inserted through the aperture 56 and the aperture 94 to secure the support plate 50 to the plate support bracket 80.

Referring now to FIG. 9, the installation of the plate support bracket 80 onto the top of the guide track 20 is illustrated. The top two retaining slots 22 in the guide track 20 are used to support the plate support bracket 80. The fourth tab 88 is inserted into the top one of the retaining slots 22, and the third tab 86 is inserted into the next lower one of the retaining slots 22 with the plate support bracket 80 at an angle to the guide track 20 as shown in FIG. 9.

The plate support bracket 80 is then brought to an upright position bringing it in line with the guide track 20, causing the fourth tab 88 to be fully inserted into the top one of the retaining slots 22, and the third tab 86 to be fully inserted into the next lower one of the retaining slots 22. It will be appreciated that the weight of the barrel assembly (not shown in FIGS. 9 and 10, but suspended from the U-shaped support bracket 40) will maintain the fourth tab 88 in a fully inserted position in the top one of the retaining slots 22, and the third tab 86 in a fully inserted position in the next lower one of the retaining slots 22.

Figures 11, 12:
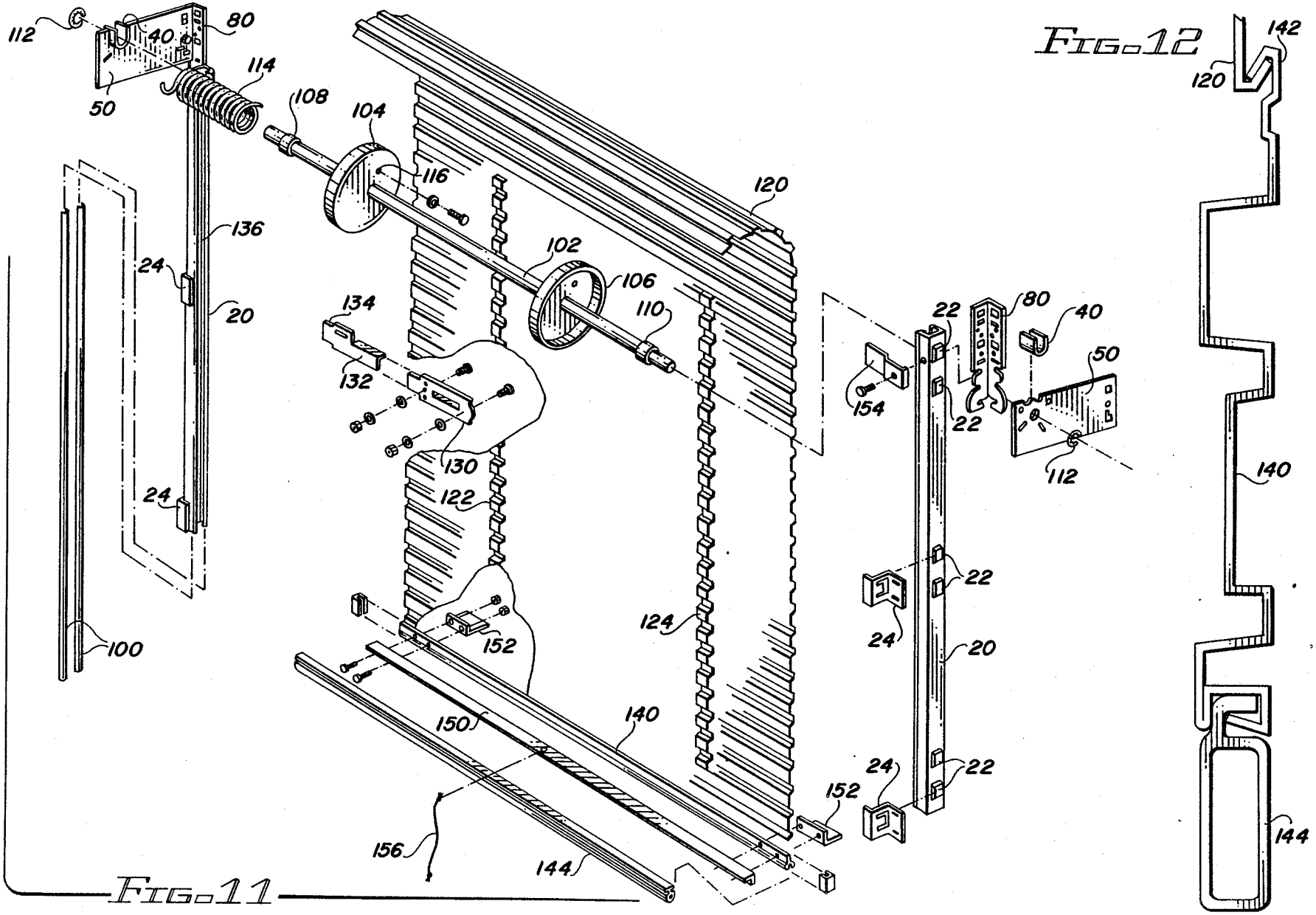
FIG. 11 is an exploded perspective view of the entire roll-up door of the present invention illustrating the construction thereof.
FIG. 12 is a side view of the bottom edge of the door, which bottom edge is made of a formed metal sheet and fastened to the lower edge of the door in a double reentrant joint.

Moving now to FIG. 11, the complete assembly of the present invention may be explained and understood. It will be immediately understood by those skilled in the art that the components described up to this point herein are universal; in other words, the same component may be used and will fit on either side of the roll-up door. The guide track 20 is the first such component, and may be used on opposite sides by merely turning it end-for-end. The retaining slots 22 are located equidistant from each end, and therefore only one guide track 20 need be manufactured instead of distinct left and right guide tracks. The mounting bracket 24 may also be used in any of the multiple retaining slots 22 on a guide track 20 on either side of the door.

As discussed above, the plate support bracket 80 is made of two portions on each side of the bend therein which are mirror images of each other. This enables the plate support bracket 80 to be used on either side of the door. One face of the plate support bracket 80 will be directed inwardly with respect to the opening in which the door is situated. The other face of the plate support bracket 80 will be directed directly away from the opening, and as such will lie flat against the wall adjacent the opening. Again, since the plate support bracket 80 will fit on either side of the door, only one plate support bracket 80 need be manufactured.

The support plate 50 is entirely of flat construction, and it will be appreciated that the first tab 82 and the second tab 84 may fit into the rectangular notch 52 and the L-shaped notch 54, respectively, from either side. Accordingly, only a single support plate 50 must be manufactured. Likewise, the U-shaped support bracket 40 will fit onto a support plate 50 on either side of the door, so only a single U-shaped support bracket 40 need be manufactured.

The guide tracks 20 have a plastic door slide 100 having a C-shaped or U-shaped cross sectional configuration mounted on each of the two longitudinal edges (FIG. 3) thereof, with the plastic door slides 100 functioning to guide the door when it is raised or lowered. A guide track 20 is installed on each side of the opening immediately inside the edge of the opening, with the side of the guide track 20 on the right as the guide track 20 is shown in FIG. 3 facing the outside of the wall having the opening in which the door is to be installed. A plate support bracket 80 is attached to the top pair of retaining slots 22 on each on the guide tracks 20, with one face of the plate support bracket 80 being directed inwardly with respect to the opening in which the door is situated, and the other face of the plate support bracket 80 being directed directly away from the opening and flat against the wall adjacent the opening therein.

A mounting bracket 24 is mounted in one of each pair of retaining slots 22 in the guide tracks 20, except for the top pair of retaining slots 22 in each guide track 20, which has the plate support bracket 80 mounted therein. The mounting brackets 24 are placed in the one of each pair of the retaining slots 22 which in the opinion of the installer best facilitates attachment of the mounting bracket 24 to the wall surrounding the opening in which the door is being installed. It should also be noted again that the guide tracks 20 may have more pairs of retaining slots 22 therein if the guide tracks are very long.

The guide tracks 20 are retained in place by lag screws or other such hardware (not shown) inserted through at least one of the first and second slots 34, 36 in each of the mounting brackets 24, and through at least one of the first and second slots 90, 92 in each of the plate support brackets 80. As mentioned previously, the different sizes of the first and second slots 34, 36 and the first and second slots 90, 92 enable the use of different sizes of lag bolts or other mounting hardware. Also, only one lag bolt is required to secure each of the mounting brackets 24 and the plate support brackets 80.

The U-shaped support brackets 40 are mounted as previously described onto the support plates 50. The barrel assembly, which is supported by the U-shaped axle support brackets 40, may now be described. An axle 102 has a pair of support wheels 104, 106 mounted thereon, which support wheels 104, 106 will both support the door and provide a means around which the door may be rolled as it is raised. The axle 102 has a pair of retaining sleeves 108, 110 mounted near the ends thereof. When the ends of the axle 102 are inserted into and supported by the U-shaped support brackets 40, the retaining sleeves 108, 110 prevent lateral movement of the axle 102 in the U-shaped support brackets 40. The ends of the axle 102 preferably extend slightly through the U-shaped support brackets 40, to allow a frictional retaining ring 112 to be slipped over the ends of the axle 102, thereby also retaining the ends of the axle 102 in the U-shaped support brackets 40.

A torsion spring 114 is attached at one end of the axle 102. The torsion spring 114 has at its ends provisions for securing the ends with bolts. One end of the torsion spring 114 is secured to an aperture 116 in the support wheel 104 by a bolt, and the other end of the torsion spring 114 is secured to one of the two apertures 62, 64 or the two notches 66, 68 by a bolt. Although only one torsion spring 114 is shown in FIG. 11, a second torsion spring could be used at the other end of the axle 110. If a second torsion spring is used, it would be secured at one end to the support wheel 106, and at the other end to the support plate 50 at that end of the axle 110.

A formed metal curtain type door 120 is attached to and suspended from the support wheels 104, 106 at the top thereof, as is conventional in the art. The door 120 has on the inside thereof two flexible spacer/runners 122, 124, which are adhesively affixed to the door 120 in line with the positions of the support wheels 104, 106 to absorb the wear occasioned by the door 120 bearing against the support wheels 104, 106, and to prevent abrasion between adjacent rolls when the door 120 is being raised or lowered.

The door 120 has mounted thereon a slide bolt assembly consisting of a the slide bolt support member 130 which is mounted to the outside of the door 120 with bolts. Slideably mounted in the slide bolt support member 130 is a slide bolt 132. The slide bolt 132 has a tongue 134 which extends toward the side of the door 120. When the slide bolt 132 is in the open position, the tongue 134 is retracted into the slide bolt support member 130, allowing the door 120 to be opened or closed freely. When the slide bolt 132 is in the closed position, the tongue 134 extends out from the slide bolt support member 130 beyond the edge of the door 120. By having an aperture 136 in the guide track 20 to receive the tongue 134, the door 120 may be locked in its fully closed (down) position. The slide bolt support member 130 and the slide bolt 132 have cooperating apertures therein to allow a lock to retain the slide bolt 132 in either a fully closed or a fully opened position.

The bottom edge of the door 120 is reinforced by using a reinforcing beam 140, which is preferably fastened to the bottom of the door 120 by using a double re-entrant joint. The reinforcing beam 140 is preferably made of formed sheet stock, as shown in the cross-sectional illustration of FIG. 12. A double re-entrant joint 142 is formed by inserting a bent portion on the bottom of the door 120 into a cooperating bent portion on the top of the reinforcing beam 140. The bent portions of the door 120 and the reinforcing beam 140 are then pressed together to form a secure joint therebetween. A sealing strip 144 is retained in the bottom of the reinforcing beam 140 to provide a water resistant seal between the bottom of the door 120 and the floor or ground.

Figure 13:
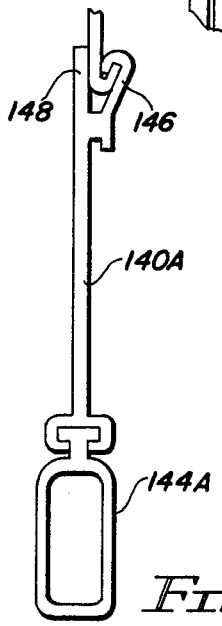
FIG. 13 is a side view of an alternate bottom edge of the door, which alternate bottom edge is made of extruded aluminum.

Alternately, the reinforcing beam 140 may be made using a metal molding, as shown in the reinforcing beam 140A shown in FIG. 13. The reinforcing beam 140A has a hook portion 146 at the top thereof which hook 146 engages the bent portion on the bottom of the door 120. A cooperating planar surface 14 retains the bent portion on the bottom of the door 120 in engagement with the hook 146 when the hook 146 and the planar portion 148 are pressed together, thereby forming a secure joint between the door 120 and the reinforcing beam 140A. A sealing strip 144A is is retained in the bottom of the reinforcing beam 140A to provide a water resistant seal on the bottom of the door 120.

Referring again to FIG. 11, a segment of angle iron 150 is shown mounted onto the reinforcing beam 140 on the inside of the door 120. Similarly, on the opposite side of the reinforcing beam 140 two angle segments 152 are mounted, preferably using the same mounting hardware as used to mount the segment of angle iron 150. The angle segments 152 may be used to allow the door 120 to be closed using a foot.

The segment of angle iron 150 is used to restrain the door 120 from being opened too far. A retaining segment 154 in mounted onto one of the guide tracks 20 at the top thereof and on the inside thereof. When the door 120 is fully opened, the segment of angle iron 150 will contact the retaining segment 154, thereby preventing the door 120 from opening further. An additional retaining segment 154 may be similarly mounted on the other guide track 20. Completing the construction of the system, a rope 156 may be attached to the center of the segment of angle iron 150, thereby allowing the door 120 to be easily pulled down. This is particularly useful if the door 120 is too high to allow a user to reach the bottom of the door when it is fully opened.

Figure 14:
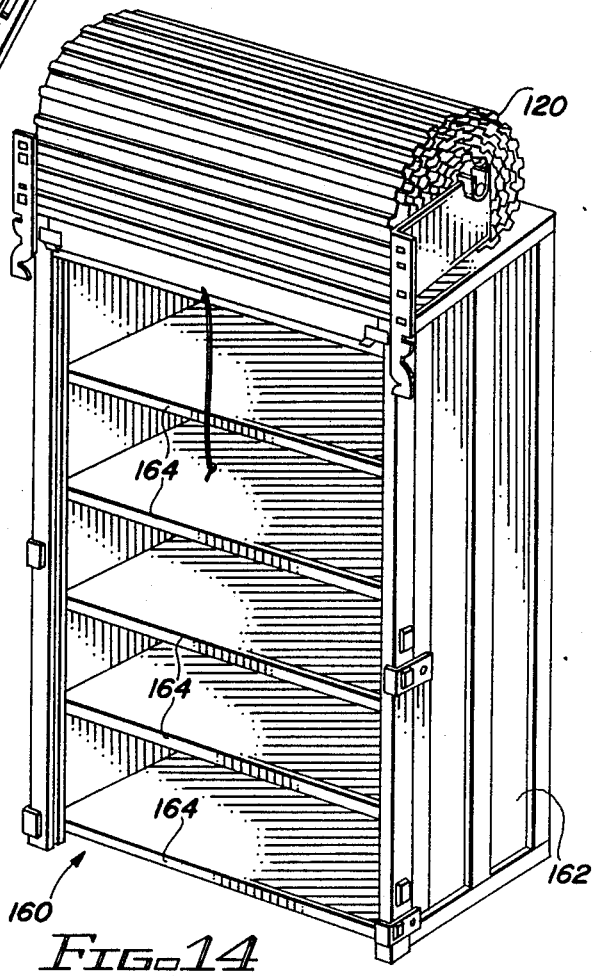
FIG. 14 is a perspective view of a security storage shelf unit using the roll-up door of the present invention.

Referring now to FIG. 14, an alternate embodiment of the present invention is shown which uses the door assembly described above to make a secure storage unit 160. By attaching a door such as that described above to the front of a metal shelf unit 162 having a plurality of shelVes 164 therein, the storage unit 160 with shelves is made securable. The roll-up door 120 is mounted on guide tracks 20 which are mounted onto the front edges of the sides of the storage unit 162. The barrel assembly (not shown in FIG. 14) is thereby mounted over the top of the shelf unit 162. It will be appreciated that this innovation is highly useful in an industrial setting to store goods or equipment which must be locked up to prevent theft.

Those skilled in the art will recognize that the door of the present invention offers many advantages over the art, most notably of which is the reduction in parts needed to assemble the door. This reduction in parts, which comes from both the ability to use a single part on either the right or the left side, and from the reduction in hardware required to assemble and install the door, is obtained at no cost in quality, durability, or long term dependability whatsoever. The roll-up doors of the present invention may thus be manufactured at lower cost and sold at reduced prices, giving them a tremendous competitive advantage over prior art roll-up doors. The installation of the door is quicker, easier, and equally secure when compared to prior art doors. The roll-up door of the present invention therefore offers significant advantages over the art while incurring no relative disadvantage whatsoever. Additionally, the door may be used in conjunction with a shelf type storage unit to provide a secure storage unit.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A security door system for mounting in a door opening, comprising:

a pair of identical guide tracks for vertical installation as door guide members on both sides of a door, each of said identical guide tracks being universally mountable to encompass either side edge of said door opening;

a pair of identical plate support brackets for installation onto the top of said guide tracks, each of said plate support brackets being universally mountable onto a guide track on either side of the door opening, said plate support brackets extending above the top edge of the door opening;

a pair of identical support plates for installation onto said plate support brackets to be supported thereby, each of said support plates being universally mountable onto a plate support bracket on either side of the door opening, said support plates extending inwardly from the top of the door opening;

a barrel assembly horizontally, rotatably mounted on said support plates; and a roll-up door mounted at the top thereof to and supported by said barrel assembly, said roll-up door being positionable to cover said door opening with the side edges of said roll-up door being retained by said guide tracks, said roll-up door being rolled about said barrel assembly as the door is raised, wherein each of said support plates has a circular aperture therein at the end of said support plates away from said plate support brackets, and said system additionally comprises:

a pair of U-shaped axle support brackets each having a notch therein which notch extends throughout the curved section of said U-shaped support bracket and up much of the length of the legs of said U-shaped support bracket, said notch in one of said U-shaped support brackets fitting over the top edge of each said support plate, said curved section of said U-shaped support brackets being concentric with and slightly smaller in diameter than said circular aperture in each of said support plates, said support plates each having means therein for retaining one of said U-shaped support brackets in position thereon.

2. A security door system as defined in claim 1, wherein said guide tracks define channels to retain the side edges of said roll-up door, each of said guide tracks having two longitudinal edges, one of said longitudinal edges being on each side of said roll-up door when said roll-up door is installed in place, additionally comprising:

a plastic door slide mounted on each of said longitudinal edges of each of said guide tracks to guide said roll-up door when it is raised or lowered, said plastic door slides having a preselected cross sectional configuration enabling them to be retained on said longitudinal edges.

3. A security door system as defined in claim 1, wherein each of said guide tracks has a plurality of pairs of longitudinally spaced retaining slots formed therein, said slots for receiving tabs orthogonal to said guide tracks, a pair of said retaining slots being located equidistant from each end of the guide track.

4. A security door system for mounting in a door opening, comprising:

a pair of identical guide tracks for vertical installation as door guide members on both sides of a door, each of said identical guide tracks being universally mountable to encompass either side edge of said door opening;

a pair of identical plate support brackets for installation onto the top of said guide tracks, each of said plate support brackets being universally mountable onto a guide track on either side of the door opening, said plate support brackets extending above the top edge of the door opening;

a pair of identical support plates for installation onto said plate support brackets, each of said support plates being universally mountable onto a plate support bracket on either side of the door opening, said support plates extending inwardly from the top of the door opening;

a barrel assembly horizontally, rotatably mounted on said support brackets; and a roll-up door mounted at the top thereof to and supported by said barrel assembly, said roll-up door being positionable to cover said door opening with the side edges of said roll-up door being retained by said guide tracks, said roll-up door being rolled about said barrel assembly as the door is raised;

wherein each of said guide tracks has a plurality of pairs of longitudinally spaced retaining slots formed therein, said slots for receiving tabs orthogonal to said guide tracks, a pair of said retaining slots being located equidistant from each end of the guide track; and additionally comprising:

a plurality of mounting brackets for mounting said guide tracks in position on the sides of said door opening, each of said mounting brackets having a tab so arranged and configured as to precisely slideably engage one of said retaining slots, each of said mounting brackets having a mounting portion which lies flat against and is secured to a wall on the inside of said door opening.

5. A security door system as defined in claim 4, wherein said mounting portion of each of said mounting brackets has a first smaller slot and a second larger slot located therein to allow different size mounting hardware to be used to secure said mounting brackets.

6. A security door system for mounting in a door opening, comprising:

a pair of identical guide tracks for vertical installation as door guide members on both sides of a door, each of said identical guide tracks being universally mountable to encompass either side edge of said door opening;

a pair of identical plate support brackets for installation onto the top of said guide tracks, each of said plate support brackets being universally mountable onto a guide track on either side of the door opening, said plate support brackets extending above the top edge of the door opening;

a pair of identical support plates for installation onto said plate support brackets, each of said support plates being universally mountable onto a plate support bracket on either side of the door opening, said support plates extending inwardly from the top of the door opening;

a barrel assembly horizontally, rotatably mounted on said support brackets; and a roll-up door mounted at the top thereof to and supported by said barrel assembly, said roll-up door being positionable to cover said door opening with the side edges of said roll-up door being retained by said guide tracks, said roll-up door being rolled about said barrel assembly as the door is raised;

wherein each of said guide tracks has a plurality of pairs of longitudinally spaced retaining slots formed therein, said slots for receiving tabs orthogonal to said guide tracks, a pair of said retaining slots being located equidistant from each end of the guide track; and wherein said plate support brackets have a 90 degree longitudinal bend therein, with the half portions of said plate support bracket on each side of said 90 degree bend being mirror images, each half portion having four tabs thereon, a first tab being near the top of said half portion with the open end of said first tab facing upwardly, a second tab being below said first tab on said half portion with the open end of said second tab facing away from said 90 degree bend, with each of said first and second tabs being parallel to and spaced away from the surface of said plate support bracket, a third tab being located at the bottom of said half portion and facing toward said 90 degree bend, and a fourth tab being located above said third tab and facing away from said 90 degree bend, with each of said third and fourth tabs being formed by material cut away from said half portion.

7. A security door system as defined in claim 6, wherein each of said plate support brackets is mounted with said third and fourth tabs on one half portion thereof fitting into the pair of retaining slots on the top end of one of said guide tracks, and the other half portion of each of said plate support brackets laying flat against and being secured to a wall on the inside of said door opening.

8. A security door system as defined in claim 7, wherein each half portion of each of said plate support brackets has a first smaller slot and a second larger slot located therein to allow different size mounting hardware to be used to secure said plate support brackets.

9. A security door system as defined in claim 7, wherein each of said support plates has two slots therein at an end thereof to receive said first and second tabs in one of said plate support brackets, said support plates therewith being mounted and suspended from said plate support brackets.

10. A security door system as defined in claim 1, wherein said barrel support comprises:

an axle rotatably supported by said U-shaped support brackets, said axle being restrained against longitudinal movement with respect to said U-shaped support brackets;

a pair of support wheels mounted on and rotating with said axle, said roll-up door being mounted onto said support wheels; and a torsion spring mounted about said axle and secured at one end thereof to one of said support wheels, said torsion spring being secured at the other end thereof to the one of said support plates closest said one of said support wheels, said torsion spring balancing the weight of said roll-up door to allow it to be easily raised or lowered.

11. A security door system as defined in claim 10, additionally comprising:

a second torsion spring mounted about said axle and secured at one end thereof to the other of said support wheels, said second torsion spring being secured at the other end thereof to the other of said support plates.

12. A security door system as defined in claim 10, additionally comprising:

a pair of flexible spacer/runners adhesively affixed to the inside of said roll-up door in line with the positions of said support wheels to absorb the wear occasioned by said roll-up door bearing against said support wheels, and to prevent abrasion between adjacent rolls when said roll-up door is being raised or lowered.

13. A security door system as defined in claim 1, additionally comprising:

a slide bolt support member mounted to one side of said roll-up door adjacent the side thereof;

a slide bolt slideably mounted in said slide bolt support member, said slide bolt having a tongue which extends toward said one side of said roll-up door, said tongue being retracted into said slide bolt support member when said slide bolt is in an open position, thereby allowing said roll-up door to be opened or closed freely, said tongue extending out from said slide bolt support member beyond said one side of said roll-up door when said slide bolt is in a closed position;

an aperture in the one of said guide tracks adjacent said one side of said roll-up door to receive said tongue when said slide bolt is in a closed position to allow said roll-up door to be locked in its fully closed position.

14. A security door system as defined in claim 13, wherein said slide bolt support member and said slide bolt have cooperating apertures therein to allow a lock to retain said slide bolt in either position in which it is placed.

15. A security door system as defined in claim 1, additionally comprising:

a reinforcing beam mounted on the bottom of said roll-up door, the bottom edge of said roll-up door and the top edge of said reinforcing beam both being shaped with a re-entrant edge portion, said re-entrant edges on the bottom edge of said roll-up door and the top edge of said reinforcing beam being hooked and pressed together to lock them together in a double re-entrant joint configuration.

16. A security door system as defined in claim 15, additionally comprising:

a sealing strip which is retained in the bottom of the reinforcing beam to provide a water resistant seal between the bottom of the door and the floor or ground.

17. A security door system as defined in claim 15, wherein said reinforcing beam is made of formed sheet stock.

18. A security door system as defined in claim 15, wherein said reinforcing beam is made of a metal molding and said re-entrant edge portion comprises a hook at the top of said metal molding, which hook engages said re-entrant portion on the bottom of said roll-up door, and said metal molding also has at the top thereof a cooperating planar surface to retain said re-entrant portion on the bottom of said roll-up door in engagement with said hook when said hook and said planar portion are pressed together.

* * * * *